US011053712B2

(12) United States Patent
Lin

(10) Patent No.: US 11,053,712 B2
(45) Date of Patent: Jul. 6, 2021

(54) CHAIN LOCK

(71) Applicant: Yu-Pin Lin, Tainan (TW)

(72) Inventor: Yu-Pin Lin, Tainan (TW)

( * ) Notice: Subject to any disclaimer, the term of this patent is extended or adjusted under 35 U.S.C. 154(b) by 317 days.

(21) Appl. No.: 16/371,125

(22) Filed: Apr. 1, 2019

(65) Prior Publication Data

US 2020/0308878 A1 Oct. 1, 2020

(51) Int. Cl.
*E05B 73/00* (2006.01)
*E05B 67/00* (2006.01)
*E05B 17/14* (2006.01)

(52) U.S. Cl.
CPC ..... *E05B 73/0005* (2013.01); *E05B 17/142* (2013.01)

(58) Field of Classification Search
CPC .. E05B 73/0005; E05B 17/142; E05B 17/188; E05B 67/003; E05B 71/00
USPC ... 70/14, 18, 30, 49, 58, 233, 360, 361, 386
See application file for complete search history.

(56) References Cited

U.S. PATENT DOCUMENTS 3,071,958 A * 1/1963 Russo ..... E05C 17/365 70/93
4,347,720 A * 9/1982 Kenyon ..... E05B 67/003 70/14
4,887,444 A * 12/1989 de Brouwer-Elzenbroek ..... B62H 5/145 70/233
8,646,297 B2 * 2/2014 Foti ..... B62H 5/18 70/233
8,881,559 B1 * 11/2014 Chang ..... E05B 67/003 70/49
8,904,831 B2 * 12/2014 Stevens ..... E05B 67/003 70/14
2003/0140662 A1 * 7/2003 Hsu ..... E05B 73/0082 70/18
2011/0048082 A1 * 3/2011 Thomas ..... E05B 67/003 70/21

* cited by examiner

*Primary Examiner* — LLoyd A Gall

(57) ABSTRACT

A chain lock includes a main body, a rotatable part, a cylinder, a plug provided with a tailpiece, and a chain. The main body defines therethrough a first channel and a second channel. The rotatable part defines therethrough a third channel. The rotatable part is rotatably mounted to the main body. The cylinder is slidably fitted into the first channel of the main body and biased by a compression spring. The plug together with the tailpiece is rotatably mounted in the cylinder. The chain includes a series of rings, one ring of which is located in the second channel of the main body and inserted through by the cylinder. In use, a second ring of the chain can be located in the third channel of the rotatable part to be inserted by the cylinder, and the plug can be rotated by a key to have the cylinder fixed in place.

9 Claims, 8 Drawing Sheets

CHAIN LOCK

BACKGROUND OF THE INVENTION

1. Field of the Invention

The present invention relates to a chain lock and, more particularly, to a chain lock including a main body and a rotatable part, wherein the rotatable part can be rotated relative to the main body by any angle to facilitate operation and achieve a best anti-theft effect.

2. Description of the Prior Art

Chain locks can be used to lock an object onto a frame or fixed object. For example, a user can use a chain lock to tie a bicycle onto a post. Some existing chain locks employ a chain and a lock body, which can be in the form of combination or keyed padlocks, wherein two ends of the chain can be connected to the lock body. When the chain lock is not in use, the chain or the lock body is easy to lose. To solve this problem, another type of chain locks was developed, wherein one end of the chain is always attached to the lock body. As shown in FIGS. 1 and 2, a conventional chain lock generally includes a lock body 10 and a chain 14. The lock body 10 defines a first cutout 100 and a second cutout 101 and is provided therein with a plug 12 provided with a tailpiece 13 that is fitted with a compression spring 11 and inserted through one end ring of the chain 14 located in the first cutout 100 of the lock body 10. After the chain 14 is routed through an object desired to be fastened, another end ring of the chain 14 can be located in the second cutout 101 and inserted through by the tailpiece 13. Although this type of chain locks can prevent loss of components, the end rings of the chain 14 should be located at fixed, opposite positions. Thus, in a limited space or a condition where the angular span between the two end rings of a chain needs to be adjusted, the use of the conventional chain lock is inconvenient.

SUMMARY OF THE INVENTION

One object of the present invention is to provide a chain lock that can solve the disadvantages of conventional chain locks.

The chain lock generally comprises a main body, a rotatable part, a cylinder, a plug, and a chain. The main body defines therethrough a first channel and a second channel communicating with the first channel. An outwardly extending rim is formed at a bottom of the main body. The rotatable part is constructed of a metal seat embedded in a plastic shell. The metal seat defines an inner space coaxial and communicating with a central space of the plastic shell that opens out at a top of the plastic shell. A third channel is defined through the plastic shell to communicate with the central space of the plastic shell and located above the metal seat. An annular groove is defined at an inner surface of the metal seat that defines the inner space of the metal seat. An inwardly extending rim is formed at the top of the plastic shell and fitted over the outwardly extending rim of the main body so that the rotatable part is rotatably mounted to the main body, and the first channel of the main body is coaxial with the central space of the plastic shell and the inner space of the metal seat. The cylinder is slidably fitted into the first channel of the main body and biased by a compression spring. The cylinder defines a receiving space therein and at least one through hole communicating the receiving space and the first channel of the main body. The plug, which defines a keyhole, is provided thereunder with a tailpiece. The tailpiece together with the plug is rotatably mounted in the receiving space of the cylinder. The tailpiece defines at its outer surface at least one arcuate groove corresponding to the through hole of the cylinder. An engagement ball is received between the arcuate groove of the tailpiece and the through hole of the cylinder. The chain includes a series of rings, one ring of which is located in the second channel of the main body and inserted through by the cylinder. In use, a second ring of the chain can be located in the third channel of the rotatable part, the cylinder can be moved downwardly to insert through the second ring of the chain and to have the through hole thereof aligned with the annular groove of the metal seat provided in the rotatable part, and the plug can be rotated by a key to have the engagement ball moved into the annular groove of the metal seat provided in the rotatable part, thus closing the chain to tie or fasten an object.

Furthermore, an end plate defining a central opening is attached to a top of the main body, wherein the central opening corresponds to the first channel of the main body and has a dimension less than an upper channel section of the first channel but greater than the plug. Preferably, the end plate is formed with a cover capable of closing the central opening of the end plate.

The chain lock is advantageous in that the rotatable part can be rotated relative to the main body by any angle. This feature is useful in an application where a limited space is available for the lock.

Other objects, advantages, and novel features of the present invention will become more apparent from the following detailed description when taken in conjunction with the accompanying drawings.

DETAILED DESCRIPTION OF THE PREFERRED EMBODIMENTS

To illustrate the effects and advantages of the present invention, a preferred embodiment is provided in the following paragraphs with reference to the accompanying drawings.

Figure 1:
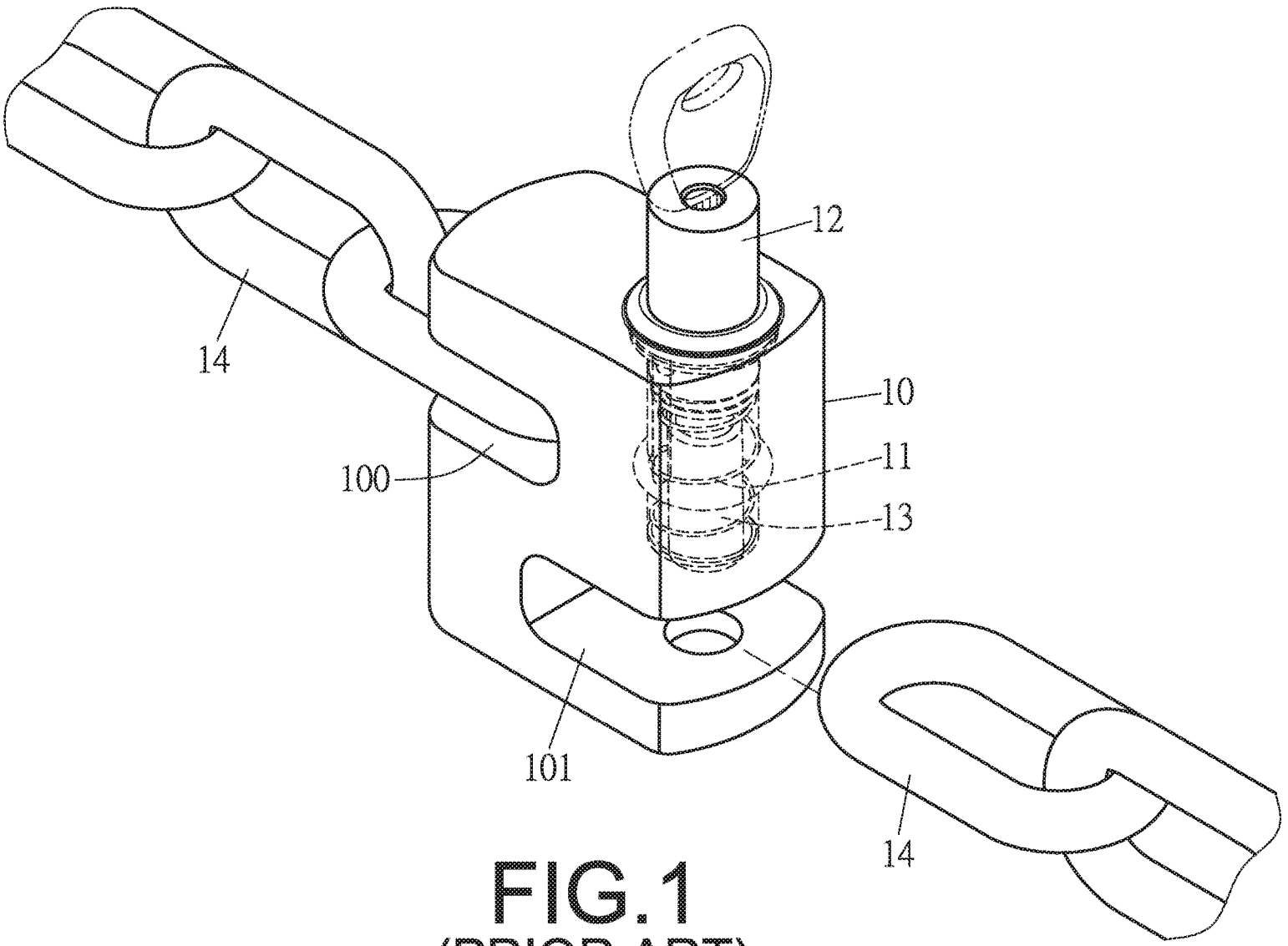
FIG. 1 (PRIOR ART)
FIG. 1 shows a 3-dimensional view of a conventional chain lock, which includes a lock body and a chain attached to the lock body at one end ring thereof.
Figure 2:
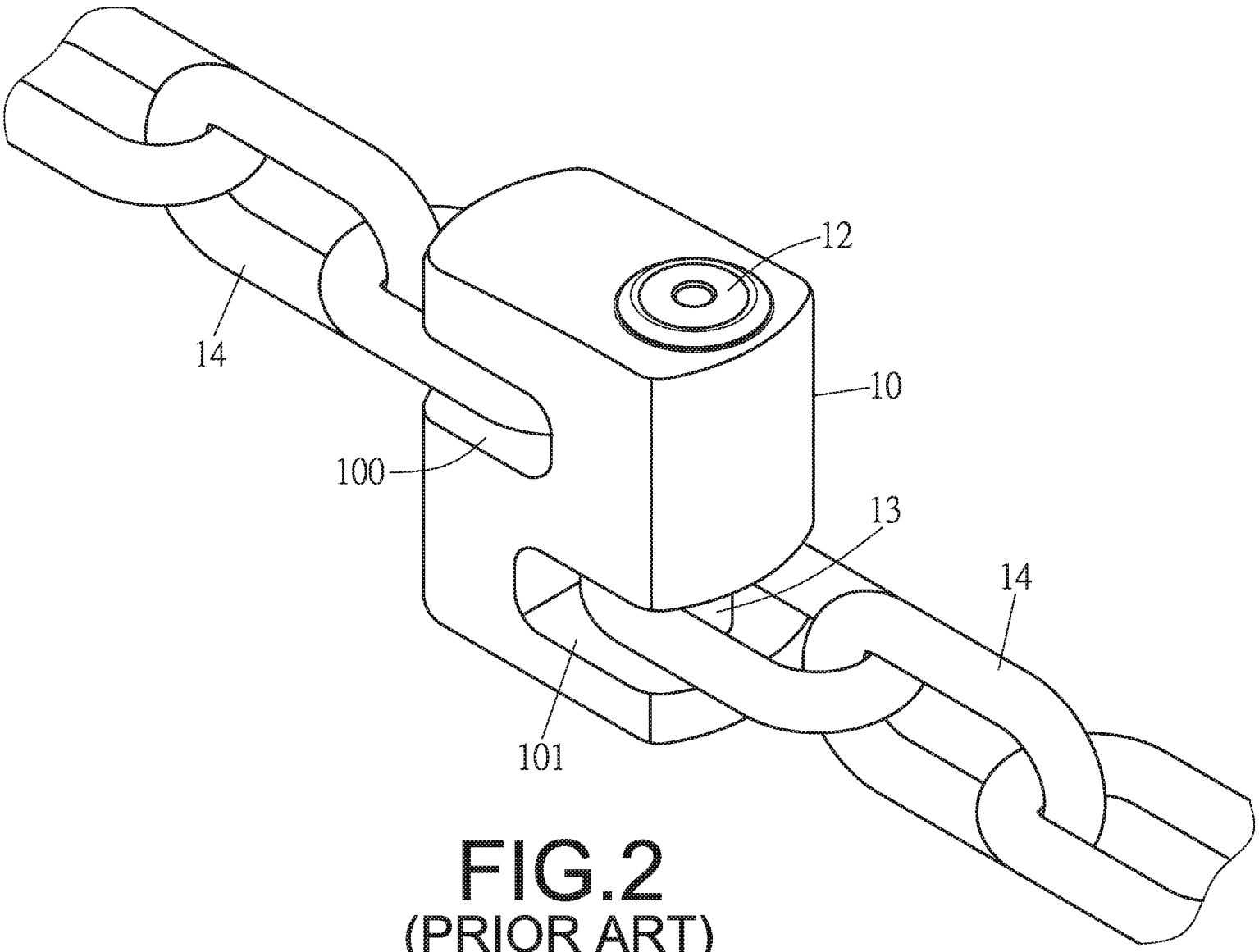
FIG.2 (PRIOR ART)
FIG. 2 shows a 3-dimensional view of the conventional chain lock, wherein a second end ring of the chain is attached to the lock body.
Figure 3:
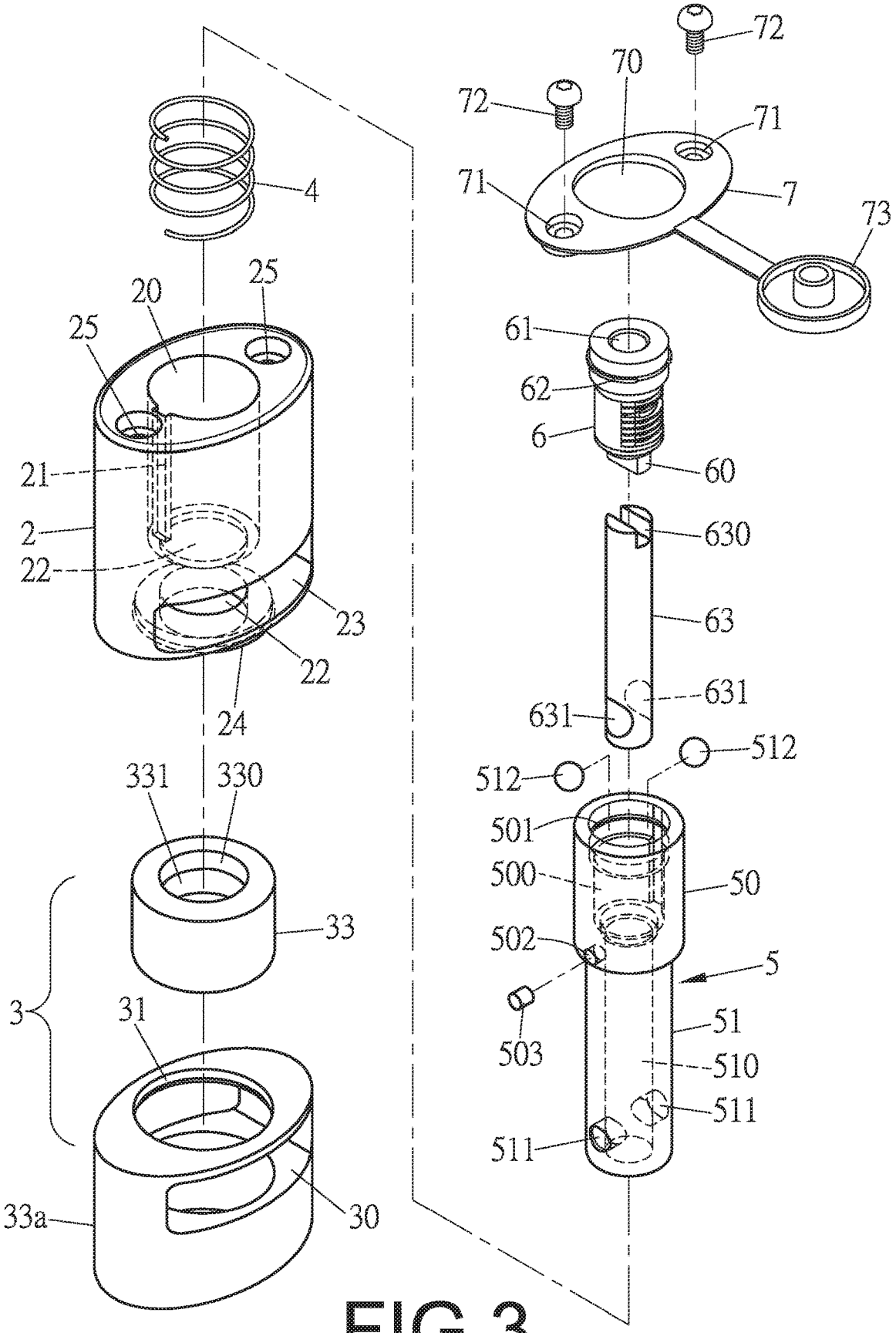
FIG. 3 shows an exploded view of a chain lock according to one embodiment of the present invention.
Figure 4:
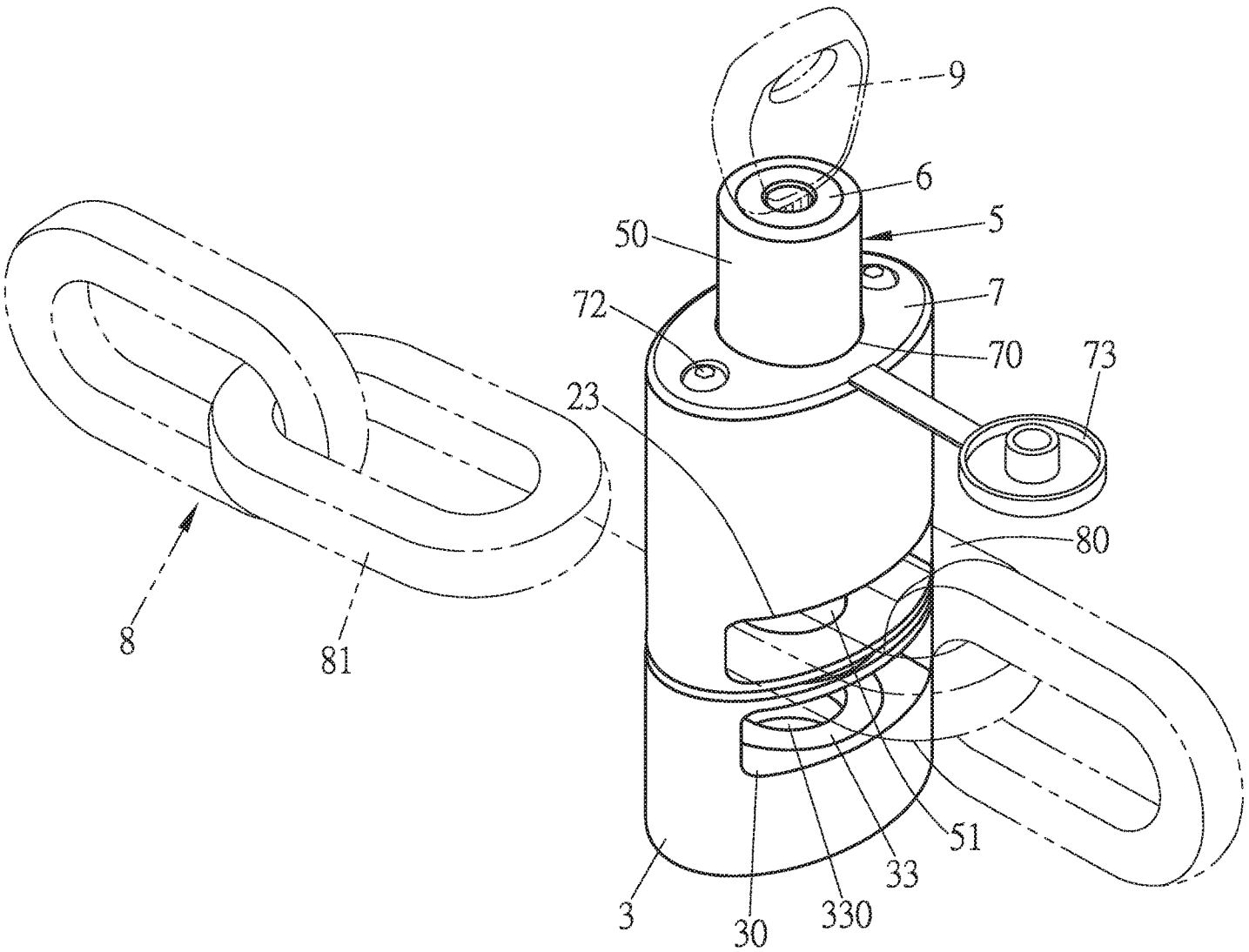
FIG. 4 shows an assembled view of the chain lock of the present invention.
Figure 5:
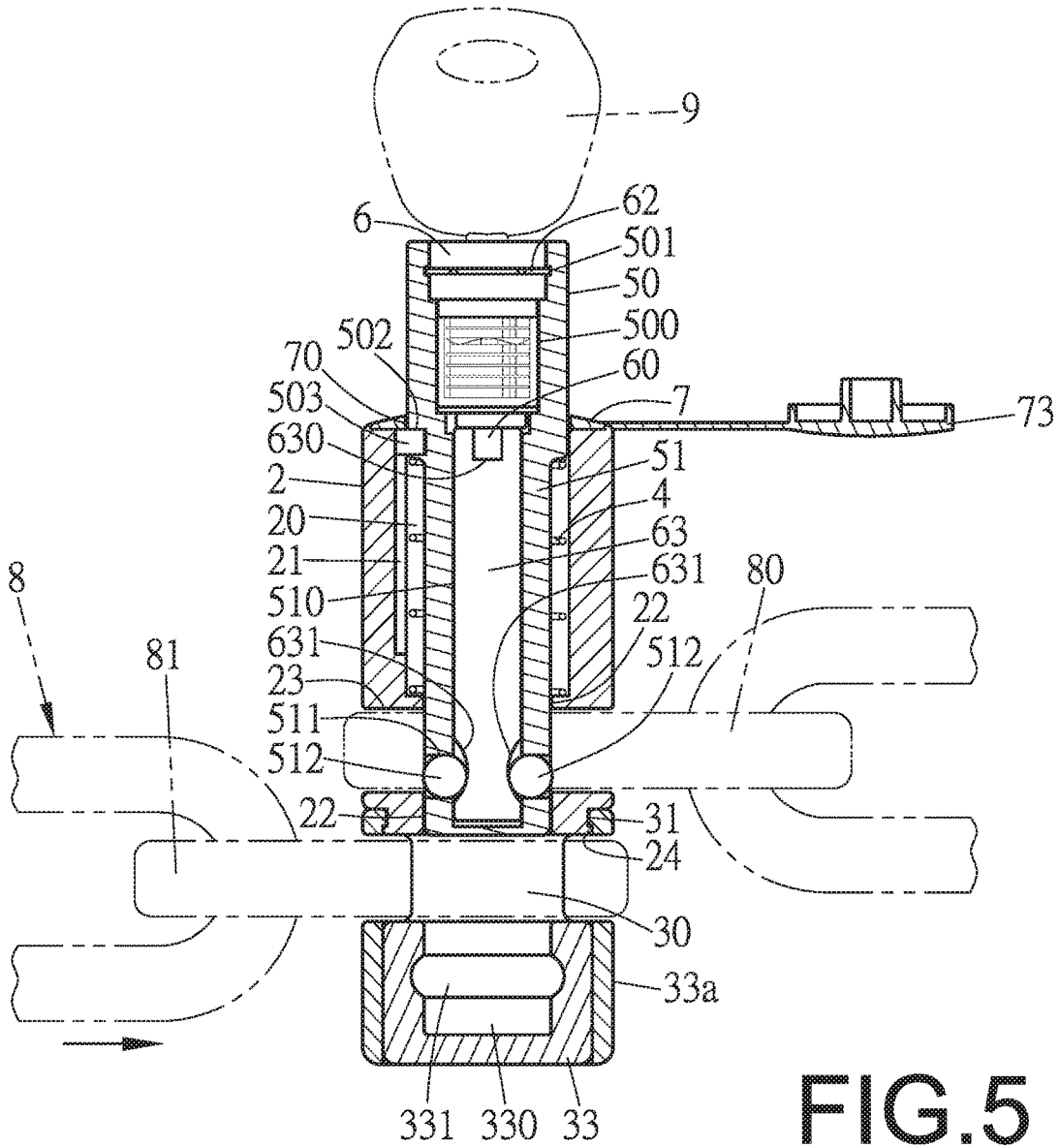
FIG. 5 shows a sectional view of the chain lock of the present invention.
Figure 6:
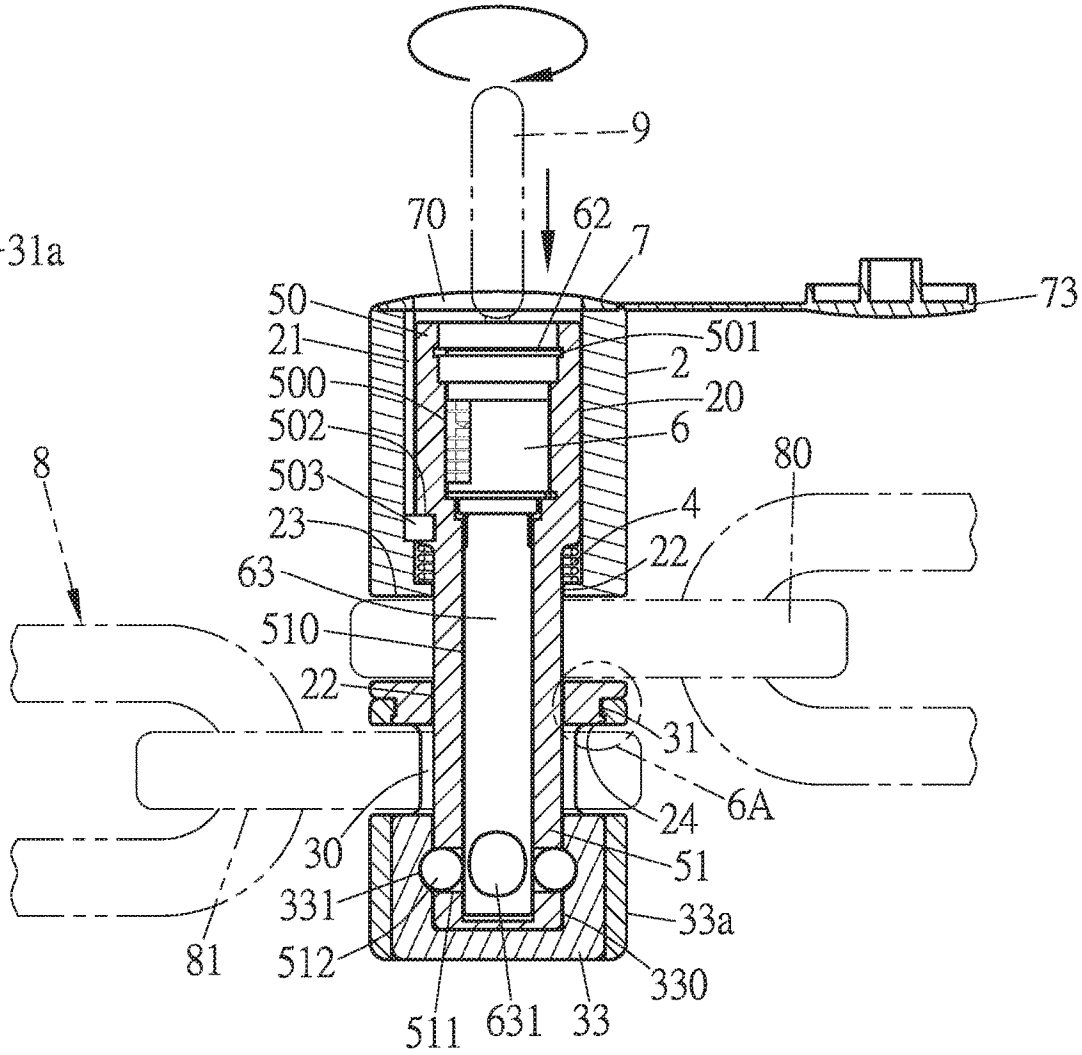
FIG. 6 shows a sectional view of the chain lock of the present invention, wherein the second end ring of the chain is fixed at the lock body.
Figure 6A:
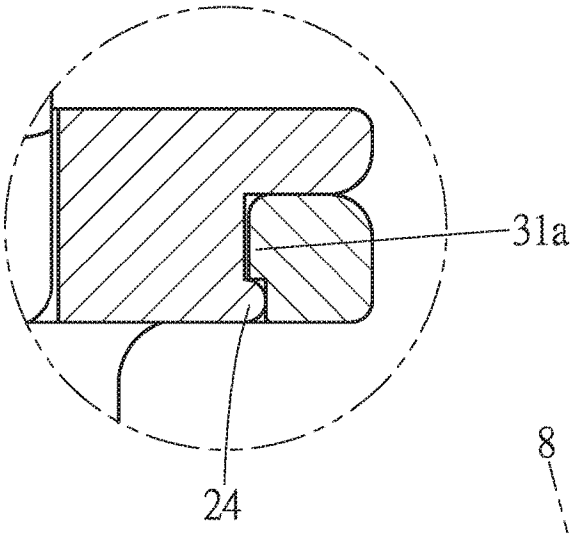
FIG. 6A shows an enlarged view of 6A of FIG. 6.
Figure 7:
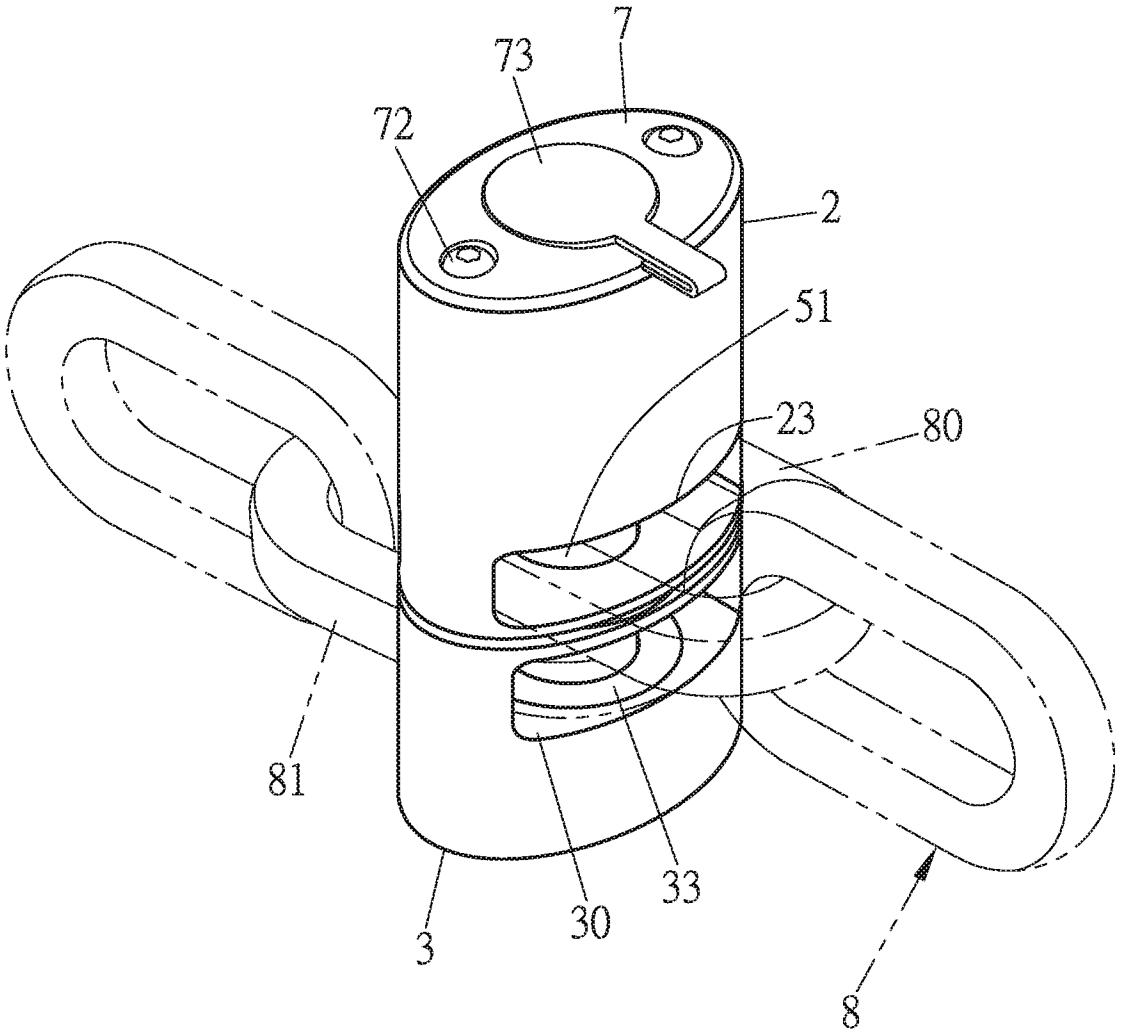
FIG. 7 shows a working view of the chain lock, wherein the rotatable part of the lock is not rotated.

Referring to FIGS. 3 through 5, a chain lock according to one embodiment of the present invention is shown, which generally comprises a main body 2, a rotatable part 3, a cylinder 5, a plug 6, an end plate 7, and a chain 8.

The main body 2 defines therethrough a first channel, including an upper channel section 20 and a lower channel section 22, and a second channel 23 substantially perpendicular to the first channel and communicating with the first channel. The lower channel section 22 has a dimension less than the upper channel section 20. An outwardly extending rim 24 is formed at a bottom of the main body 2 around an opening of the lower channel section 22.

The rotatable part 3 is constructed of a metal seat 33 embedded in a plastic shell 33*a*. The metal seat 33 defines an inner space 330 coaxial and communicating with a central space 31 of the plastic shell 33*a* that opens out at a top of the plastic shell. A third channel 30, which is defined through the plastic shell 33*a* and located above the metal seat 33, communicates with the central space 31 of the plastic shell 33*a* and is substantially perpendicular to the central space 31. An annular groove 331 is defined at an inner surface of the metal seat 33 that defines the inner space 330 of the metal seat. An inwardly extending rim 31*a* is formed at the top of the plastic shell 33*a* around an opening of the central space 31 and fitted over the outwardly extending rim 24 of the main body 2 so that the rotatable part 3 is rotatably mounted to the main body 2, and the first channel of the main body 2 is coaxial with the central space 31 of the plastic shell 33*a* and the inner space 330 of the metal seat 33.

The cylinder 5, which has a head portion 50 and an extension portion 51, is slidably fitted into the first channel of the main body 2 and biased by a compression spring 4. The cylinder 5 defines therein a receiving space, which includes an upper space section 500 located in the head portion 50 thereof, and a lower space section 510 located in the extension portion 51 thereof. An annular groove 501 is defined at an inner surface of the cylinder 5 that defines the upper space section 500 of the cylinder 5. Furthermore, the cylinder 5 defines two through holes 511, at the extension portion 51 thereof, communicating with the receiving space of the cylinder 5 and the first channel of the main body 2. It is noticed that one end of the compression spring 4 can be urged against the bottom of the head portion 50 of the cylinder 5 while an opposite end of the compression spring 4 can be urged against a step formed between the upper and lower space sections 500, 510 of the cylinder 5. As such, the compression spring 4 can push the cylinder 5 upwardly to have the head portion 50 projected out of the main body 2.

The plug 6, which defines a keyhole 61, is provided or coupled thereunder with a tailpiece 63. In this embodiment, the plug 6 and the tailpieces 63 are made in the form of separate pieces. As shown, the plug 6 is formed with a protrusion or blade 60 at a bottom thereof, while the tailpiece 61 defines an indentation 630 at a top thereof. The protrusion 60 can be engaged in the indentation 630 of the tailpiece, so that the tailpiece 63 is rotatable with the plug 6. The plug 6 is provided at its outer surface with a C-shaped ring 62, which can be fitted into the annular groove 501 of the cylinder 5. The plug 6 together with the tailpiece 63 is rotatably mounted in the receiving space of the cylinder 5, wherein the plug 6 is located in the upper space section 500 while the tailpiece 63 is located in the lower space section 510. Furthermore, the tailpiece 63 defines at its outer surface two arcuate grooves 631 corresponding to the through holes 511 of the cylinder 5. Two engagement balls 512 can be received between the arcuate grooves 631 of the tailpiece 63 and the through holes 511 of the cylinder 5.

The chain 8 includes a series of rings, one end ring 80 of which can be located in the second channel 23 of the main body 2 and inserted through by the extension portion 51 of the cylinder 5, a second end ring 81 of which can be located in the third channel 30 of the rotatable part 3 to be inserted through by the extension portion 51 of the cylinder 5.

To prevent the cylinder 5 from rotating relative to the main body 2 and to facilitate downward movement of the cylinder 5, the cylinder 5 can be provided at its out surface with a guide pin 503, which can be fixed to a fixing hole 502 of the cylinder 5. A guide slot 21 can be defined at an inner surface of the main body 2 that defines the upper channel section 20 of the first channel of the main body 2. When moving the cylinder 5, the guide pin 503 can move along the guide slot 21.

Furthermore, an end plate 7 defining a central opening 70 is attached to a top of the main body 2, wherein the central opening 70 corresponds to the first channel of the main body 2 and has a dimension less than the upper channel section 20 of the first channel, but greater than the head portion 50 of the cylinder 5. More specifically, the main body 2 can define a plurality of threaded holes 25 at its top; the end plate 7 can define a plurality of the through holes 71. The end plate 7 can be attached to the main body 2 using a plurality of screws 72 that are inserted through the through holes 71 of the end plate 7 and screwed into the threaded holes 25 of the main body 2. Preferably, the end plate 7 can be formed with a cover 73 capable of closing the central opening 70 of the end plate 7, so that dust can be prevented from entering the main body 2 and the keyhole 61 of the plug 6.

In assembling the foregoing components, first of all, the inwardly extending rim 31*a* of the rotatable part 3 can be fitted over the outwardly extending rim 24 of the main body 2, so that the rotatable part 3 is rotatably mounted to the main body 2. Secondly, the engagement balls 512 can be placed into the through holes 511 of the cylinder 5. Thirdly, the plug 6 and the tailpiece 63 can be inserted into the receiving space of the cylinder 5 such that the C-shaped ring 62 is snapped into the annular groove 501 of the cylinder 5 so that the plug 6 can be rotatably mounted in the cylinder 5, and the arcuate grooves 631 correspond to the through holes 511 of the cylinder 5 so that the engagement balls 512 can be partially located in the arcuate grooves 631. Fourthly, the end ring 80 of the chain 8 can be located in the second channel 23 of the main body 2. Sixthly, the compression spring 4 can be fitted around the extension portion 51 of the cylinder 5, and then the cylinder 5 assembled with components can be inserted into the first channel of the main body 2, wherein the extension portion 51 of the cylinder 5 can insert though the end ring 80 of the chain 8. Finally, the end plate 7 can be attached to the top of the main body 2 by using a plurality of screws 72.

In use, as shown in FIGS. 5 through 8, the chain 8 can be routed through an object desired to be fastened, such as a bicycle's frame or wheel, and then the second end ring 81 of the chain 8 can be located in the third channel 30 of the rotatable part 3 and aligned with the first channel of the main body 2 as well as the inner space 330 of the metal seat 33 (see FIG. 5). Next, the cylinder 5 can be pushed downwardly to have the extension portion 51 inserted through the second end ring 81 of the chain 8 and inserted into the inner space 330 of the metal seat 3 provided in the rotatable part 3. As a result, the compression spring 4 can be further compressed, and the through holes 511 of the cylinder 5 can be aligned with the annular groove 331 of the metal seat 3. Next, a key 9 can be inserted in into the keyhole 61 of the plug 6 to rotate the plug 6 and the tailpiece 63. As such, the engagement balls 512 can be forced to move away from the arcuate grooves 631 to be partially located in the annular groove 331 of the metal seat 33 (see FIG. 6), thereby fixing the cylinder 5 in the lower position and closing the chain 8. Finally, the key 9 can be taken out of the plug 6, and the cover 73 can be used to close the central opening 70 of the end plate 7, so that dust can be prevented from entering the main body 2 and the keyhole 61 of the plug 6.

To unlock the chain lock of the present invention, first of all, the cover 73 can be taken from the end plate 7 to expose the plug 6, and then the key 9 can be inserted into the keyhole 61 of the plug 6 to turn the plug 6 in a reverse direction to have the arcuate grooves 631 of the tailpiece 63 to align with the through holes 511 of the cylinder 5, so that the engagement balls 512 can move back into the arcuate grooves 631 of the tailpiece. Consequently, the cylinder 5 can be forced by the compression spring 4 to move upwardly, so that the head portion 50 of the cylinder 5 can project out of the main body 2 (see FIG. 5), and the extension portion 51 of the cylinder 5 can be clear of the second end ring 81 of the chain 8, so that the chain 8 can be opened and the end ring 81 of the chain 8 can be removed from the rotatable part 3 to release the object.

Figure 8:
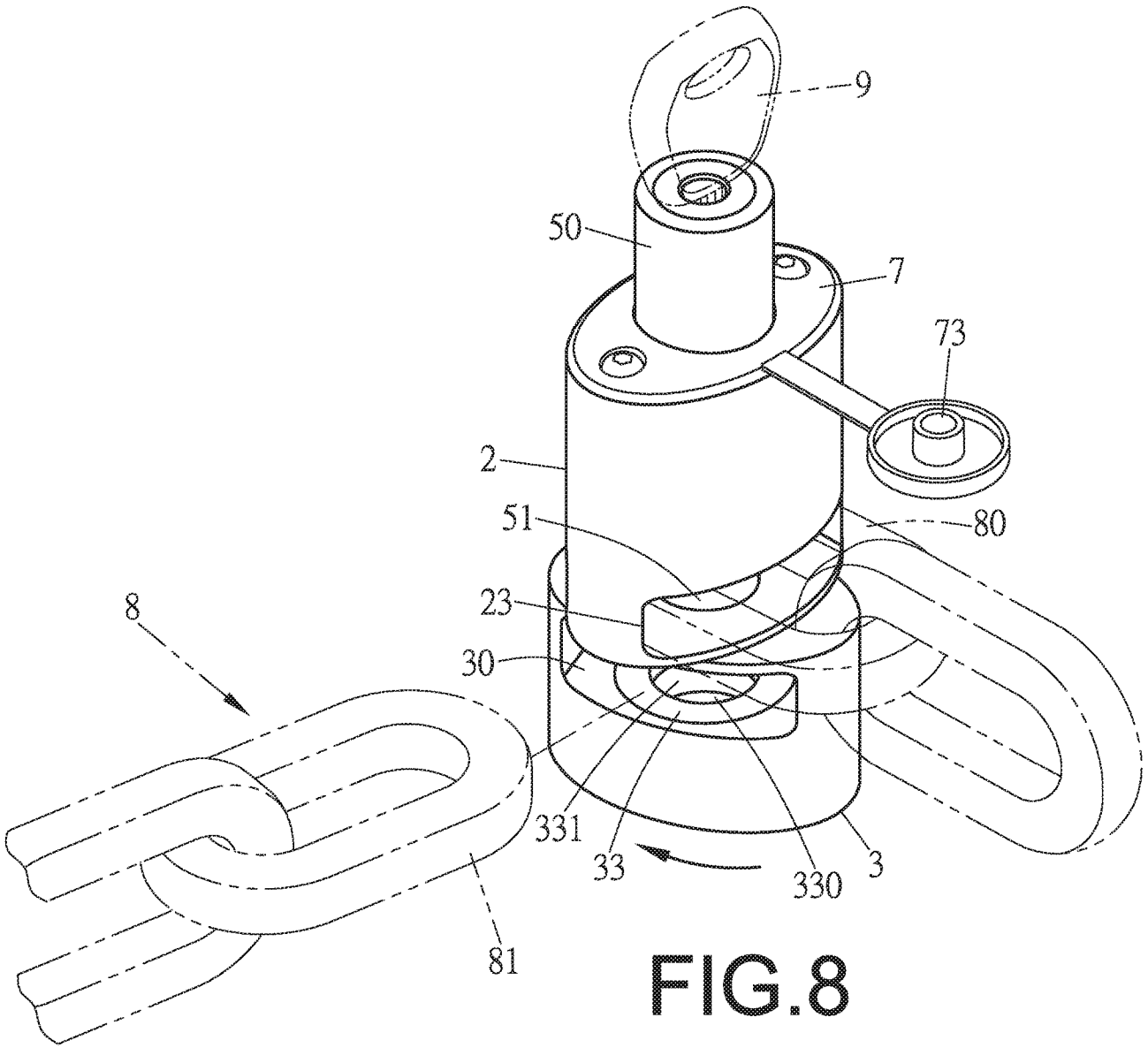
FIG. 8 shows a working view of the chain lock, wherein the rotatable part of the lock is rotated relative to the main body of the lock.

The chain lock of the present invention is advantageous in that the width of the lock can be reduced significantly; the rotatable part 3 can be rotated relative to the main body 2 by any angle (see FIG. 8). This feature is useful in an application where a limited space is available for the lock; the lock is provided with a cover that can prevent dust from entering the keyhole 61 of the plug 6. Thus, the chain lock of the present invention is easy to use and can achieve an excellent anti-theft effect.

While the invention has been described with reference to the preferred embodiment above, it should be recognized that the preferred embodiment is given for the purpose of illustration only and is not intended to limit the scope of the present invention and that various modifications and changes, which will be apparent to those skilled in the relevant art, may be made without departing from the scope of the invention.

What is claimed is:

1. A chain lock, comprising:

a main body defining therethrough a first channel and a second channel communicating with the first channel, wherein an outwardly extending rim is formed at a bottom of the main body;

a rotatable part constructed of a metal seat embedded in a plastic shell, the metal seat defining an inner space coaxial and communicating with a central space of the plastic shell that opens out at a top of the plastic shell, a third channel defined through the plastic shell to communicate with the central space of the plastic shell and located above the metal seat, an annular groove defined at an inner surface of the metal seat that defines the inner space of the metal seat, wherein an inwardly extending rim is formed at the top of the plastic shell and fitted over the outwardly extending rim of the main body so that the rotatable part is rotatably mounted to the main body, and the first channel of the main body is coaxial with the central space of the plastic shell and the inner space of the metal seat;

a cylinder slidably fitted into the first channel of the main body and biased by a compression spring, wherein the cylinder defines a receiving space therein and at least one through hole communicating the receiving space and the first channel of the main body;

a plug defining a keyhole and provided thereunder with a tailpiece, the tailpiece together with the plug being rotatably mounted in the receiving space of the cylinder, wherein the tailpiece defines at its outer surface at least one arcuate groove corresponding to the through hole of the cylinder, and an engagement ball is received between the arcuate groove of the tailpiece and the through hole of the cylinder; and a chain including a series of rings, one ring of which is located in the second channel of the main body and inserted through by the cylinder;

whereby a second ring of the chain is capable of being located in the third channel of the rotatable part, the cylinder is capable of being moved downwardly to insert through the second ring of the chain and to have the through hole thereof aligned with the annular groove of the metal seat provided in the rotatable part, and the plug is capable of being rotated by a key to have the engagement ball moved into the annular groove of the metal seat provided in the rotatable part, thus closing the chain to tie or fasten an object.

2. The chain lock of claim 1, wherein the plastic shell is formed around the metal seat by plastic injection molding.

3. The chain lock of claim 2, wherein the first channel of the main body includes an upper channel section and a lower channel section having a dimension less than the upper channel section; the cylinder has a head portion and an extension portion having a dimension less than the head portion; the through hole of the cylinder is defined at the extension portion of the cylinder; the compression spring is fitted around the extension portion of the cylinder and located in the upper channel section of the first channel of the main body.

4. The chain lock of claim 3, wherein the receiving space of the cylinder includes an upper space section located in the head portion thereof, and a lower space section located in the extension portion thereof; an annular groove is defined at an inner surface of the cylinder that defines the upper space section; the plug is provided at its outer surface with a C-shaped ring capable of being fitted into the annular groove of the cylinder.

5. The chain lock of claim 4, wherein the plug has a protrusion formed at a bottom thereof while the tailpiece has a depression defined at a top thereof, the protrusion of the plug capable of being engaged in the depression of the tailpiece, so that the tailpiece is rotatable with the plug.

6. The chain lock of claim 5, wherein the head portion of the cylinder is provided with a guide pin at an outer surface thereof; a guide slot is defined at an inner surface of the main body that defines the upper channel section of the first channel, the guide pin capable of moving along the guide slot.

7. The lock chain of claim 3, wherein an end plate defining a central opening is attached to a top of the main body, the central opening corresponding to the first channel of the main body and having a dimension less than the upper channel section of the first channel but greater than the head portion of the cylinder.

8. The chain lock of claim 7, wherein the end plate is formed with a cover capable of closing the central opening of the end plate.

9. The chain lock of claim 8, wherein the main body defines a plurality of threaded holes at its top, the end plate defines a plurality of the through holes, and the end plate is attached to the main body by using a plurality of screws inserted through the through holes of the end plate and screwed into the threaded holes of the main body.

* * * * *